US005820747A

United States Patent [19]

Lenglet et al.

[11] Patent Number: 5,820,747

[45] Date of Patent: Oct. 13, 1998

[54] STEAM CRACKING PROCESS AND FACILITY COMPRISING INJECTION OF POWDER WHICH IS COLLECTED AT A SINGLE POINT

[75] Inventors: Eric Lenglet, 36 Elysée 2, 78170 La Celle Saint Cloud; Paul Broutin, Chaponost; Jean-Pierre Burzynski, Sainte-Foy-Les Lyon; Hervé Cazor, Vienne; Roland Huin, Montesson La Borde, all of France

[73] Assignees: Institut Francais du Petrole; Procedes Petroliers et Petrochimiques, both of Rueil Malmaison; Eric Lenglet, La Celle Saint Cloud, all of France

[21] Appl. No.: 836,147

[22] PCT Filed: Dec. 22, 1995

[86] PCT No.: PCT/FR95/01718

§ 371 Date: Jun. 25, 1997

§ 102(e) Date: Jun. 25, 1997

[87] PCT Pub. No.: WO96/20256

PCT Pub. Date: Jul. 4, 1996

[30] Foreign Application Priority Data

Dec. 26, 1994 [FR] France ..... 94 15746

[51] Int. Cl.[6] ..... C10G 9/36; C10G 9/18; B01J 8/08

[52] U.S. Cl. ..... 208/130; 208/126; 208/131; 208/132; 208/48 R; 208/48 AA; 208/48 Q; 208/151; 208/152; 208/161; 208/168; 208/174; 208/175; 208/176; 422/144; 422/145; 422/146; 422/147; 422/200; 422/213; 422/214

[58] Field of Search ..... 208/126, 130, 208/131, 132, 48 R, 48 Q, 67, 150, 151, 152, 161, 171, 173, 174, 175, 176, 168, 127, 48 AA; 422/144, 145, 146, 147, 200, 213, 214

[56] References Cited

U.S. PATENT DOCUMENTS 5,183,642 2/1993 Lenglet ..... 422/213

FOREIGN PATENT DOCUMENTS 2 706 479 12/1994 France .

*Primary Examiner*—Bekir L. Yildirim
*Attorney, Agent, or Firm*—Millen, White, Zelano & Branigan, P.C.

[57] ABSTRACT

A steam cracking process and facility is described which comprises injection of erosive powder to effect at least partial decoking of transfer line exchangers without interrupting the steam cracking stream. The powder, preferably injected just upstream of the transfer line exchangers (TLE) (4), is separated from the cracked gases in primary gas/solid separators (5), temporarily stored in receiving drums at a controlled temperature and evacuated to a common powder storage and/or treatment module by pneumatic transfer by means of a relatively low flow of uncondensable gas. The process and facility can be used to collect solid fragments generated by injection of chemical compounds which are catalysts for the gasification of coke by steam.

29 Claims, 2 Drawing Sheets

STEAM CRACKING PROCESS AND FACILITY COMPRISING INJECTION OF POWDER WHICH IS COLLECTED AT A SINGLE POINT

Steam cracking is the basic process in petrochemistry. It consists of thermally cracking a mixture of hydrocarbons and steam at high temperatures of the order of 850° C. then chilling the effluents in an indirect chilling exchanger generally designated by TLX or TLE (transfer line exchanger) then fractionating the cooled effluents.

The main operating problem in this process is caused by unwanted deposits of coke in the pyrolysis tubes and in the transfer line exchanger.

In order to limit or overcome this problem, a steam cracking process has been proposed which involves injection of solid erosive particles (powder) to eliminate at least a portion of the coke deposits. The particles are injected "in line", i.e., either during the normal steam cracking operation, or during phases when the supply of hydrocarbons is temporarily and briefly stopped (normally for a period of less than two hours), the furnaces being flushed by steam alone, and remaining connected to the downstream sections for the treatment of the cracked gases. The preferred operating mode consists of injecting the particles during normal operation of the furnace, optionally temporarily increasing the volume flow rate of the cracked gases at the moment of injection of the powder, to increase the effectiveness.

In general, and particularly when mineral or metallic particles are injected, which do not essentially consist of coke, it is necessary to separate the injected powder at the outlet from the transfer line exchangers, in order not to pollute the downstream sections for treatment of the cracked gases. The recovered powder must then be stored either for evacuation if the process operates without recycling, or for recycling, at least in part.

A typical steam cracking facility has a plurality of furnaces, each generally having several transfer line exchangers (TLE) for the effluents; for example, there may be ten furnaces each with two TLEs, giving a total of 20 TLEs operating in parallel.

For reasons of cost and maintenance, it is preferable for there to be only a very limited number of drums for receiving and storing the recovered powder (used powder) and/or any equipment for its treatment before recycling.

The number of drums for receiving and/or the number of modules for treating the recovered powder for recycling may, for example, be limited to a maximum of two.

Preferably, if possible a single module for receiving and/or treating recovered powder is chosen, which is common to the whole steam cracking facility.

In a first variation of the described process, all the effluents from the different TLEs are collected. This is generally carried out in a conventional steam cracking facility without injection of erosive powder, and the powder is separated from the totality of the effluent from the steam cracking facility to recover this powder at a single point. This involves the installation of a very high capacity cyclone which is difficult and costly to install, to treat the entirety of the steam cracking effluents, and also to transport solid particles in the totality of the circuits for collecting the cracked gases.

This technical solution is costly and has risks associated with possible erosion of the numerous bends in the collection circuits; in addition, the efficiency of a very large cyclone is very mediocre.

In a further variation of the steam cracking process involving injection of erosive powder and recovery thereof at a single point, doses of powder are sequentially injected into different points in the facility, for example successively upstream of the different TLEs and/or coils in the pyrolysis tubes and, coordinated with the powder injection, sequentially directing the different effluents charged with the particles to a single gas/solid separation module.

As an example, the effluents from each TLE can be sequentially directed, at the corresponding moment of injection of the powder upstream of the TLE under consideration, to a single cyclone to recover particles transported by the cracked gases (injected powder and eroded coke particles from the walls); this means that only a single medium sized cyclone has to be installed whose capacity corresponds to the cracked gases from a single TLE, rather than the totality of TLEs in the steam cracker. This, however, requires the installation of sets of valves with relatively large diameters to direct the effluents from each TLE either to the downstream sections of the steam cracker when powder is not being injected upstream of that TLE, or to the single cyclone when powder is being injected upstream of that TLE.

The valves, which must be able to resist erosion, are very expensive for typical dimensions of diameters of 250 to 300 mm for the gas passages.

This variation in the process and facility thus avoids having to install a very high capacity cyclone of low efficiency, which is often impossible to install in the numerous existing steam crackers, but is also very expensive since it requires a large number of special large diameter valves (for example 20 valves for a steam cracker containing 10 TLEs). Further, the lines connecting the outlets from the different TLEs to the single cyclone are relatively large in diameter (also generally 250 to 300 mm) and must be made of alloy steel since they transport cracked gases at high temperatures, typically 450° C. to 530° C. at the end of a cycle.

French patent FR-A-2 706 479 describes a process and apparatus for steam cracking comprising injection of powder upstream of the TLEs in a steam cracker and the separation of this powder from the cracked effluent gas in primary cyclones. A portion of the effluent gas fed to the primary cyclones transports the separated powder to a common recovery means then to a storage means. The presence of condensable hydrocarbons at low pressures in the cracked effluent gas impairs good powder transfer, risking a blockage in the facility. The prior art is also illustrated in International patent application WO-A-90 12851.

A first aim of the process of the invention and its corresponding facility is to provide a reliable, inexpensive technical solution to the problem of collecting the powder circulating in steam cracking effluents at a single point when anticoking agents in the form of erosive powders are injected.

A second aim of the process of the invention and its corresponding facility is to solve the same technical problem when a further type of anti-coking agent is injected which has no notable erosive action, but which also causes the circulation of undesirable solid fragments and particles.

A family of highly active chemical compounds can be introduced to catalyse the gasification of coke by steam in the pyrolysis tubes.

These highly active compounds can be injected during decoking phases using steam alone to greatly accelerate the decoking rate. They can also be injected during steam cracking to reduce the coking rate or stop coking, catalysing the gasification of coke by the diluting steam.

It has become clear that these chemical compounds (i.e., with notable erosive capacity) cause crumbling, doubtless mechanical, generated by the circulation of the gases, probably due to embrittlement of the coke by the chemical compounds.

It should also be noted that these fragments of crumbled coke have a positive erosive action on the coke in the transfer line exchangers located downstream. These fragments can cause erosion in lines downstream of the TLE, resulting in pollution problems in the chilling oil (blocked filters, pieces which are too large to be burned in a conventional burner). Thus they are undesirable.

The object of the invention is thus to provide a steam cracking process which benefits from a reliable and economical general technical solution, to separate and recover at a single point the solid particles generated by various types of anticoking agents and transported by the cracked gases.

SUMMARY OF THE INVENTION

The invention thus provides a process for the steam cracking of hydrocarbons in a facility comprising at least one steam cracking furnace, the facility comprising a plurality of cracking zones and a plurality of transfer line exchangers (TLE) for the cracked gases from these cracking zones, the process comprising in line injection, at a plurality of points, of decoking agents resulting in the circulation of solid particles in the transfer line exchangers, and comprising separation of at least a portion of these solid particles from the gases which contain them and their transport to a single point to common collection means for the facility.

More precisely, at least a portion of the particles is separated from the effluents from the transfer line exchangers in a plurality of primary gas/solid separators.

At least a portion of the separated particles from the primary separators is recovered by gravity flow in a plurality of receiving drums $V_1, \ldots, V_n$, each drum $V_i$ being associated with at least one primary separator.

Finally, each of the receiving drums $V_i$ is sequentially isolated from the associated primary separator(s) then at least the majority of the particles contained in drums $V_i$ are pneumatically transferred to the common separation and collection means by a non coking transport gas with an atmospheric dew point of less than 110° C., the flow rate $q_i$ of the transport gas for evacuating the particles contained in drum $V_i$ being less than or equal to 30% by volume of the flow rate of the cracked gases passing through the primary separators associated with $V_i$.

The process of the invention has great advantages over the described prior art processes:

Firstly, the particles are separated from the cracked gases containing them, or optionally a current of steam alone, in a plurality of primary gas/solid separators.

These primary separators are thus of relatively low capacity, meaning the dimensions of the apparatus are reduced, facilitating installation, and increasing efficiency since the efficiency of a cyclone decreases rapidly with size, as with analogous separators.

Further, the particles are no longer guided towards common collection means by the cracked gases, but by a "clean" gas, which is non coking and substantially uncondensable at moderate temperatures.

This means that the particle transport lines can be relatively cold, unlagged and generally of carbon steel, without suffering coking or tar condensation problems. These lines are thus far less costly than those of the prior art processes described. Further, the risks of particles sticking in the presence of liquid condensation, and of blockages in the lines, is eliminated, which is a major advantage.

Finally, the flow rate of the gas guiding the particles is not connected to the flow rate of the cracked gases and can be far lower, for example 30% by volume or less than 20% by volume, meaning that very low diameter lines can be used: 50 to 100 mm compared with 250 to 300 mm. The special large diameter valves of the prior art process can also be eliminated.

In a preferred variation of the invention, the particles transferred from one drum $V_i$ are extracted from the drum by exclusively pneumatic means. This mode of extraction, which effects pneumatic evacuation of the totality of the particles contained in the drum (apart from any large dimension fragments which are mechanically blocked by a grate) by pressurizing the drum and supplying a transport gas at the outlet, is highly reliable compared with mechanical extraction using a screw or a lock, which components can be blocked by solid fragments of large dimensions, or sometimes experience flow problems known as bridging, with the formation of arches of powder.

Thus the operation of drums $V_i$ as a pneumatic clearing lock, which technique is known to the skilled person in other industries, manipulating powder and evacuating particles using the transport gas, greatly increases the reliability of the process of the invention compared with the prior art process described above.

In a further feature, drums $V_i$ are heated by heating means whose temperature level is between 110° C. and 340° C., preferably between 150° C. and 250° C., the temperature level remaining above the dew point of the transport gas at the maximum operating temperature of drums $V_i$. The term "temperature level" means the condensation temperature of the steam when using steam tracing or the maximum temperature level which can be maintained when using electric tracing.

This preferred disposition in the process, is of particular use when cracking heavy feeds such as heavy gas oils or vacuum distillates, and is in contrast to the prior art dispositions described in European patent EP-A-0 447 527 in which, particularly when cracking heavy feeds, the particles are raised to a high temperature, above the normal temperature at the TLE outlet, by mixing the effluents from the TLE containing them with a fraction of cracked gases which has not been cooled from around the TLE, in order to vaporise tar traces. We have surprisingly discovered that powder which has come into contact with cracked gases, including the cracked gases from the pyrolysis of very heavy feeds, rich in pyrolysis tars, are in a non coagulated state and are only slightly sticky when they have been cooled to temperatures such as those described above (less than 340° C., preferably less than 250° C.). This unexpected observation, leading to cooling the particles instead of heating them to vaporise the tars, probably derives from the particular nature of pyrolysis tars: they are constituted by heavy substances composed essentially of polyaromatic compounds which are almost pure, and unexpectedly they have very high melting points and are solid are temperatures of the order of 250° C.

The lower temperature limit of the heating means (generally 110° C., preferably 150° C.) is intended to avoid any condensation of the diluting vapour (entrained with the powder) or fractions of pyrolysed spirit.

The particles separated in a primary separator, which are at the outlet temperature of the TLE upstream from the separator, fall into a receiving drum $V_i$ by gravity flow. Since the average flow rates of the particles in a steam cracking stream, in the different variations of the process of the invention, are always very low compared with the flow rate of the cracked gases (less than 1% and generally less than 1 in a thousand), the thermal capacity of the particles is low and they are rapidly cooled, substantially to the temperature of drum $V_i$, which is determined by the temperature level in the heating means for $V_i$. Thus the particles are temporarily stored at a temperature which is less than the melting point of the pyrolysed tars.

However, it may occur that when falling, the recovered particles carry with them gaseous compounds containing condensable vapours such as heavy pyrolysed spirit vapours. In order to avoid such condensation which could cause the recovered particles to increase in weight, the gas contained in a drum $V_i$ can be flushed with a non coking gas with an atmospheric dew point (the temperature at which initial condensation occurs at atmospheric pressure) of less than 110° C. before $V_i$ is isolated, followed by transferring the particles contained in $V_i$. Flushing can also be effected by introducing a barrier gas into $V_i$ or just upstream of $V_i$, constituting a technical equivalent to the flushing.

In addition to flushing, in a preferred embodiment the particles contained in a drum $V_i$ are percolated with a non coking gas with an atmospheric dew pint of less than 110° C. before isolating drum $V_i$ and transferring the particles contained in $V_i$.

Percolation (passage through the particle bed) by a "dry" gas strips these particles and, further, eliminates any traces of liquid which may be present. In a particularly advantageous embodiment, final drying of the particles can be effected during their pneumatic transfer, in particular by maintaining the temperature of the particle/transport gas mixture after the pneumatic transfer, for example in the secondary gas/solid separator, at a value in the range 40° C. to 180° C., preferably in the range 80° C. to 150° C. These temperatures are used when the transport gas is uncondensable at room temperature (for example nitrogen or fuel gas), as is preferred. If steam is used as the transport gas, the temperatures must be raised to a point considerably above the condensation point for steam at the pressure of the secondary separator.

Final drying in a circulating fluidized bed during pneumatic transfer further improves the flow quality of the particles to a very high level.

This is very advantageous when the particles are at least partially recycled.

As stated, the preferred transport gases are uncondensable at normal temperature and pressure, and are in particular those selected from the group formed by nitrogen, methane, hydrogen, light hydrocarbons containing two to four carbon atoms, and mixtures of these compounds.

Readily available gases such as nitrogen, or fuel gas from the steam cracker (a variable mixture of methane and hydrogen) are the most suitable. These can be used with cold pneumatic transfer lines, generally unlagged.

Decoking agents can be injected during phases when the supply of hydrocarbons from the cracking zone upstream of a TLE is interrupted (circulation of steam alone).

However, a preferred variation of the process consists of injecting the decoking agents during normal operation of the facility, i.e., during the steam cracking phase when the flow rate is normal, or temporarily increased by 10% to 50% by volume in the case where erosive solid particles are introduced when the efficiency must be increased.

Regarding the decoking agents, two principal types of effective agents can be used:

In a first variation of the process, the decoking agents comprise solid erosive particles injected upstream of the transfer line exchangers, in particular into the transfer zones for the cracked gases located between the outlets to the cracking zone and the transfer line exchangers.

The average diameter of the particles can be between 0.02 and 4 mm, preferably between 0.07 and 0.8 mm. When these particles are injected into the inlet to the cracking zones, the dimensions of the particles must be reduced to less than 150 micrometers in order to approximate the effect of an erosive gas. When, on the other hand, the particles are injected at the inlet to the TLEs, in order to scrape off the coke in these TLEs and obtain high flexibility in cracking feeds which can vary from very light to very heavy feeds, larger diameter particles can be used, typically in the range 70 to 800 micrometers: TLEs do not include bends or direction changes, but only straight lengths, and there is no risk of concentrations of particle impacts causing local erosion.

A variety of particles can be used, provided they erode effectively. For this reason, it is recommended that at least 20% of angular (or very irregular) particles is used. Examples of compositions of these particles are used fluid cracking catalysts (FCC), cement clinker, ground minerals, metallic particles, or sand. Particles which are of particular interest are hard, low fragility mineral particles such as silicon carbide, or simple or mixed oxides of aluminium, silicon and zirconium. Other interesting particles are coke particles, in particular coke particles stabilised by calcining at 850° C. or above, carried out before or after grinding. These coke particles are more fragile and less effective than mineral particles, and must be injected in increased quantities. On the other hand, since these particles are combustible, the risks of polluting downstream sections, in particular polluting the pyrolysis fuel, are considerably reduced. In some cases (in particular when cracking light and middle feeds such as kerosine), recovery of the particles is simplified (less efficient recovery, but more economical than a cyclone), for example by using a "coke trap". This coke trap may be constituted by a sudden change in the flow direction of the cracked gases, for example a simple, non cyclonic deviation in the flow through an angle in the range 30° to 180° to evacuate at least a major portion of the cracked gases, and a recovery chamber for the particles located at the level of the sudden direction change, or downstream, connected by a via a neck to a receiving drum for the particles, in accordance with the invention.

The particles are preferably injected sequentially, i.e., in discontinuous fashion. Preferably, a dose of particles is successively injected, at fixed intervals or variable intervals of between 0.3 and 72 hours, preferably between 1 and 20 hours, upstream of the different TLEs equipped in accordance with the invention. At the moment of injection, the instantaneous quantity of particles with respect to the cracked gases is in the range 0.5% to 25% by weight, in particular in the range 1% and 10% by weight. If the total quantity of particles injected during one steam cracking cycle is compared with the total quantity of gases cracked during that cycle, the average particle content is then much lower, due to the fact that the particles are only injected over a small fraction of time. Typically, the average amount of solid particles injected during one steam cracking cycle with respect to the cracked gases, is less than 3000 ppm, generally in the range 20 to 1500 ppm.

In a variation of the invention, at least a portion of the particles recovered in the common collecting means is recycled, the particles being reintroduced upstream of at least one of the transfer line exchangers after effecting a jigging operation, carried out on at least that portion of the particles recovered in the common means. The jigging operation can be carried out at atmospheric pressure and in a mainly nitrogen atmosphere. The particles can also be jigged without being depressurised then recycled, for example using fuel gas.

Recycling the particles, at lest in part, has already been described in the prior art; it can reduce the consumption of "new" particles. The characteristic disposition of the process of the invention with recycling, consisting of carrying out an atmospheric pressure jigging step in nitrogen after pneumatic transfer of the particles using an uncondensable gas, is of great importance:

Because of the pneumatic transfer of the invention, both drying and cooling of the particles occurs in a circulating fluidized bed. This means that it is possible to use existing jiggers, which are economical and highly flexible, and are also known as screens, centrifuges or, preferably, jig tables. The flexible sleeves connecting these apparatus, formed from an elastomer which may be reinforced, would be incompatible with the high temperature of the particles (400° C. or more) which pass through the filter in the prior art process.

This filtering step is essential in order to avoid the risks of blocking the recycled powder injectors which are of a small diameter. Further, since jigging is carried out at atmospheric pressure and at a moderate temperature in nitrogen, maintenance of the jigger is easier and can be carried out swiftly.

Typically, fragments (coke and foreign bodies) with a diameter of more than 3 or 4 mm are eliminated.

In a further variation of the invention, the decoking agents comprise mineral salts which catalyse the gasification of coke by steam, injected upstream of the cracking zones.

In particular, these mineral salts may comprise at least one salt of an element selected from the group formed by sodium, potassium, lithium, barium and strontium, the salt promoting coke gasification.

We have discovered mineral salts which are very active for gasification of the coke from the pyrolysis tubes, comprising salts of alkaline and alkaline-earth elements, in particular precursors for the oxides or carbonates of these elements.

In particular, mixtures with a low melting point of less than 750° C. (for example, close to eutectics) of sodium carbonate and potassium carbonate have a very efficient decoking or anticoking action.

A mixture of acetates can also be used, for example an equimolar mixture of sodium acetate, potassium acetate, lithium acetate and barium acetate. These compounds, the list of which is not limiting, can catalyse the coke gasification reaction (in particular the water gas reaction: $C+H_2O \rightarrow CO+H_2$); they can be introduced in powder form or as aqueous solutions, in particular in very dilute solutions, sprayed into a hot gas, in particular into the diluting steam, or the steam/hydrocarbon mixture at the convection outlet (at a high temperature of the order of 500° C. to 650° C.).

The preferred mode of injection is injection during normal operation of the steam cracker; these mineral salts can also be injected into steam alone during decoking phases, in particular to accelerate decoking. The quantity required depends on a number of factors: the nature of the compounds used and the feed to be cracked, the cracking severity and the skin temperature of the pyrolysis tubes.

The most suitable quantities are typically between 2 and 200 ppm, preferably between 5 and 100 ppm, calculated as the weight of alkaline and/or alkaline-earth elements with respect to the cracked gases.

The invention also concerns a steam cracking facility for carrying out the process. More precisely, the facility comprises at least one steam cracking furnace, a plurality of cracking zones, and a plurality of transfer line exchangers for the cracked gases from the cracking zones, the facility also comprising means for injecting decoking agents at a plurality of points, resulting in the circulation of solid particles in the transfer line exchangers, a plurality of primary gas/solid separators for purifying the effluents from the transfer line exchangers, each primary separator being connected upstream to at least one transfer line exchanger associated therewith and comprising an outlet for purified gas and an outlet for solid particles, and means for recovering at least a portion of these solid particles comprising common separation and collection means assembled at a single point, the facility being characterized in that it comprises:

a plurality of drums $V_i$ for recovery by gravity flow of at least a portion of the particles separated in the primary separators, each drum $V_i$ being connected to at least one solid particle outlet of at least one primary separator associated with $V_i$;

a plurality of solid particle transfer channels, each channel being connected upstream to one of the drums $V_i$ and downstream to said common separation and collecting means; and means for sequentially isolating each drum $V_i$ from the primary separator(s) associated therewith, and pneumatic means for transferring at least the major portion of the particles contained in the isolated drums $V_i$ via said transfer channels, the pneumatic means comprising means for supplying a non coking transport gas with an atmospheric dew point of less than 110° C., at a flow rate $q_i$, for evacuation and transfer of the particles contained in a drum $V_i$, of less than 30% by weight of the flow rate of the gas passing through the primary separators associated with $V_i$.

This facility can thus transfer recovered powder using relatively low flow rates of non fouling transport gases, at a moderate temperature. The individual primary separators have a relatively low unit capacity compared with the overall flow rate of the cracked gases in the complete facility, and are thus efficient and easy to install. They efficiently purify the cracked gases not only during the solid particle injection phases, using the process described above, but also permanently, and are thus also effective as regards emission of solid particles after injection of the decoking agents. This is useful both for circulating residual particles circulating which have remained in dead zones after injection of the erosive particles, and when chemical coke gasification agents are injected. This facility, which does not contain any additional large diameter valves (typically of more than 150 mm) in the centralised recovery and collection portions, is thus both efficient (recovery), more reliable (fouling risks) and more economical due to the use of small diameter transfer lines, at a moderate temperature, and in the absence of special large diameter valves compatible with solid particles. The term "sequential isolation" means alternating phases in which a receiving drum $V_i$ is in upstream communication and phases where it is isolated therefrom to allow downstream evacuation to the common separation and collection means. Preferably, but not essentially, this is coordinated for the different drums $V_i$, each of the drums being able to be successively isolated, to stagger the transfers. It is also possible to empty several drums $V_i$ simultaneously.

The common collection means are typically constituted by a drum for temporary or prolonged storage of particles, which may comprise weighing means. A transfer line exchanger is said to be associated with a primary separator if the primary separator purifies the effluents from that transfer line exchanger. Similarly, a primary separator is said to be associated with a receiving drum $V_i$ if $V_i$ recovers, by gravity flow, at least a portion of the particles separated in the primary separator. Thus a primary separator can be associated with one or more transfer line exchangers whose effluents it purifies; a receiving drum $V_i$ can collect particles from one or more primary separators. In a preferred embodiment of the invention, the facility comprises at least two primary separators associated with the same receiving drum, each of the primary separators being connected to the drum via a line, and comprising control means for sequential obstruction means for at least one of the lines when the other line is open, the relative disposition of these primary separators and the receiving drum being such that the lines are inclined at an angle of at least 60 degrees to the horizontal.

This disposition means that a single drum $V_i$ can be used to receive and transfer particles from several primary separators, and is thus of interest from an economic and maintenance viewpoint. Sequential isolation of at least one of the lines avoids the circulation of cracked gases from one primary separator to the other via drum $V_i$, which is deleterious to separation efficiency.

Preferably, evacuation of the particles contained in drum $V_i$ is effected using emptying means connected to $V_i$ which are exclusively pneumatic, using at least one source of a gas selected from the group constituted by nitrogen and fuel gas (methane or a mixture of methane and hydrogen). These pneumatic emptying means, a "pneumatic clearing lock" or "pressurised drum" typically comprising pressurisation of drum $V_i$ with respect to the downstream conditions in the pneumatic transfer line and injection of transport gas at the $V_i$ outlet, are very intense, and can evacuate powders which flow with difficulty; they are more efficient than the evacuation means of the prior art process described.

The flow rate of the transport gas transferring the particles is only at most 30 volume % of the flow rate of the gas passing through the primary separators associated with $V_i$ during the same period, i.e., typically the normal flow rate of the cracked gases treated by the primary separator(s) whose particles fall into $V_i$. The transfer channel is thus of a much smaller diameter than that of the cracked gas channels (less than or equal to 100 mm as opposed to a typical value of 250 to 400 mm).

Preferably, the transport gas is fuel gas or nitrogen, which are uncondensable at room temperature, which mean that the particles can be dried during transfer. In a preferred feature of the invention, drums $V_i$ are heated by heating means where the temperature level is in the range 110° C. to 340° C., preferably in the range 150° C. to 250° C. This temperature level, which corresponds to that of the condensation temperature of the steam tracer or the temperature held by the electrical tracer, is sufficient to keep the pyrolysed tars in the solid state.

In one embodiment, the facility comprises means for flushing the gases contained in drums $V_i$ by means of a source of non coking gas with an atmospheric dew point of less than 110°C. This flushing, which is a technical equivalent of and may be constituted by a barrier gas, purges $V_i$ of any traces of cracked gases before evacuation and transfer of the particles. In a preferred embodiment, the facility comprises means for introducing a non coking gas with an atmospheric dew point of less than 110° C. into the particles contained in drums $V_i$, to percolate through the particles before evacuation from drums $V_i$.

This effects a first drying of the particles, encouraging evacuation, before that carried out during the transfer itself.

In a further embodiment, the decoking agents comprise solid erosive particles, and injection means for these particles upstream of the transfer line exchanger, in particular into the transfer zones between the cracking zones and the transfer line exchanger.

Preferably, the totality of the solid particles is injected into transfer zones for the cracked gases between the cracking zones and the transfer line exchangers, in particular into the inlet cones for the exchangers (considered to form part of the transfer zones).

Advantageously, the common separation means which effect secondary solid particle/substantially uncondensable transport gas separation comprise an outlet for purified transport gas connected via a connecting line to a circulation line for cracked gases, for the evacuation of purified transport gas.

Reconnecting all the purified transport gas outlets to a cracked gas circulation line means that all the different particle transfers to the common separation and collection means remain under pressure and in a "hydrocarbon" system. This is an important safety point compared with opening purified transport gases to atmospheric pressure.

Preferably, the transport gas is fuel gas, avoiding the consumption of nitrogen and mixing it in considerable quantities with cracked gases.

In a variation, the facility comprises recycling means for at least a portion of the particles recovered in the common separation and collection means.

In a further embodiment, the facility comprises a vibrating jig operating in a nitrogen atmosphere substantially at atmospheric pressure and at a temperature of less than 200° C., connected upstream to common separation and collection means and connected downstream to particle recycling means.

In a further embodiment, the facility comprises means for injecting decoking agents which comprise chemical compounds which catalyse the gasification of coke by steam, upstream of the cracking zones. In particular, this facility advantageously comprises means for injecting a solution comprising at least one mineral salt of an element selected from the group formed by sodium, potassium, lithium, barium and strontium, the salt being active in promoting gasification of coke by steam, gasification embrittling the coke and causing the emission of pieces of coke which can be recovered and transferred using the means of the invention.

Injection of solid erosive particles is generally effected during short injection phases which occupy only a short period of time.

Outside these short injection periods, other types of particles can circulate such as coarse coke fragments (fragments which may detach naturally from the walls following thermal shocks, for example, or which are encouraged by injection of chemical compounds which catalyse gasification).

In order to avoid mixing the two populations of particles, the invention can comprise means for sequential injection of erosive particles connected to the transfer zones, means for sequential isolation of each drum $V_i$ outside the phases for injection of particles upstream of $V_i$, and means for evacuating particles recovered from the separator(s) associated with $V_i$ outside the injection phases without passing through $V_i$.

In particular, the facility comprises receiving drums $W_i$ for particles recovered outside the particle injection phases, and controlled directional diverters at one inlet and two outlets, each diverter being connected upstream to a primary separator, and downstream to a receiving drum $V_i$ and to a receiving drum $W_i$.

BRIEF DESCRIPTION OF THE DRAWINGS

The invention will be better understood, and other features, details and advantages will become more clear, from the following description of an embodiment made by way of example, with reference to the following drawings in which.

DETAILED DESCRIPTION OF FIGURES

Figure 1:
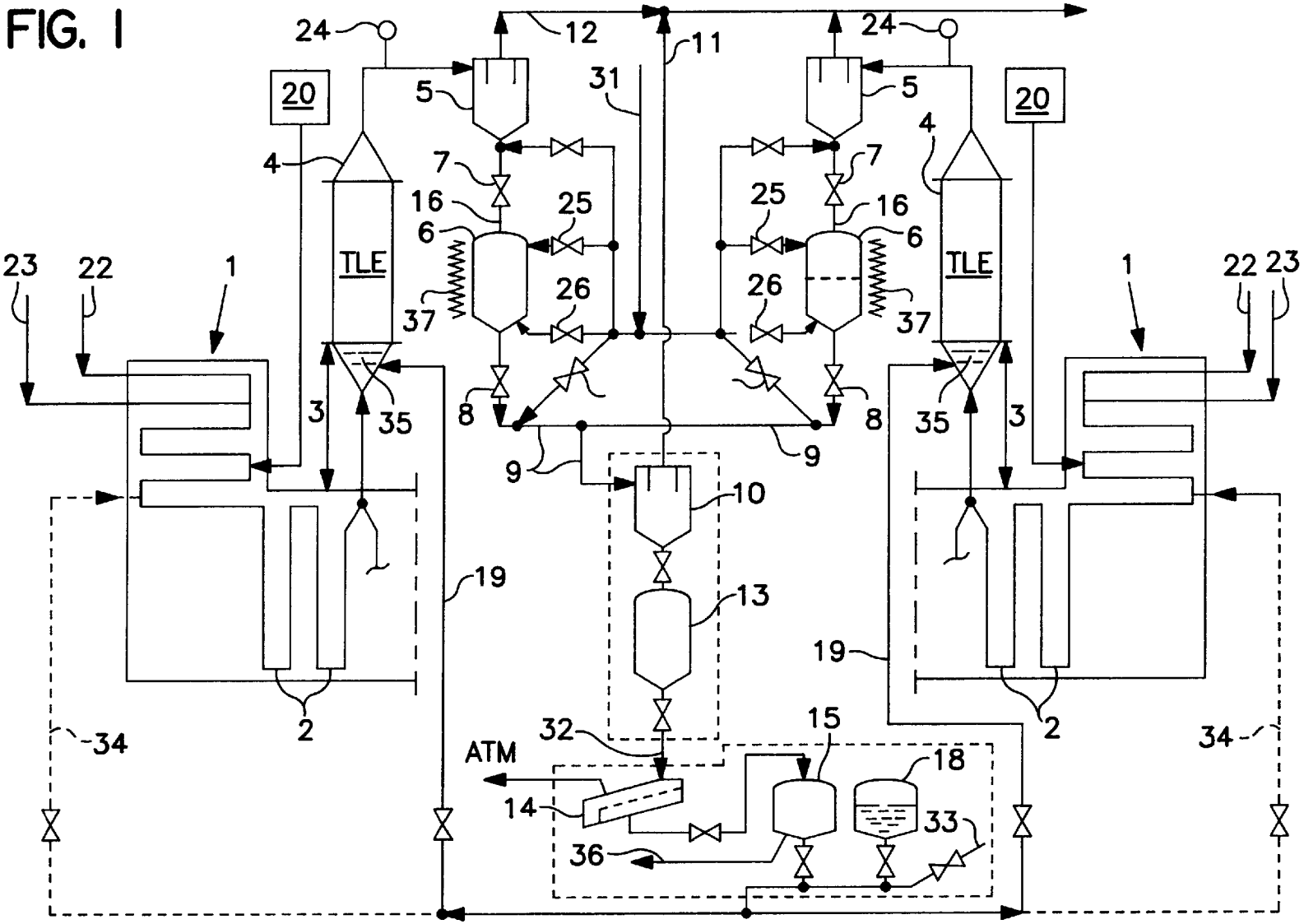
FIG. 1 schematically represents a steam cracking facility of the invention, comprising a number of devices relative to different features of the invention.

Referring firstly to FIG. 1, portions of two steam cracking furnaces (1) are shown, each comprising a supply (22) for a hydrocarbon feed and a supply (23) for diluting steam. The feed is preheated, vaporised and superheated at a temperature typically of 500° C. to 650° C. in the convection zones of these furnaces, then cracked in two cracking zones (2) constituted by coils of pyrolysis tubes. At the outlet to these cracking zones (the outlet to the furnace container), the cracked gases pass through transfer zones (3) to two transfer line exchangers (4), or TLE, which rapidly reduce the temperature to about 360° C. to 630° C., very generally to about 360° C. to 500° C. The temperature is measured by temperature gauges (24). The two streams of cooled cracked gas then pass through two primary gas/solid particle separators (5), for example two cyclones. Each primary separator comprises an outlet for purified gas which joins a line (12) circulating the cooled cracked gases, to evacuate them and carry out downstream treatment (primary fractionation, compression, desulphuration, drying, final fractionation).

The two primary separators (5) each comprise an outlet for solid particles connected via a line (16) to a receiving drum (6) whose temperature is maintained by heating means (37), to recover the solid particles by gravity flow.

The two receiving drums (6) each comprise sequential isolating means: upstream a controlled valve (7) disposed in line (16) and downstream, a controlled valve (8). The two receiving drums (6) are connected downstream, each via a transfer channel (9), to common separation and collection means for the solid particles, comprising a separating cyclone (10) and a collection drum (13). The effluent gases from cyclone (10) are introduced into line (12) via a line (11).

Collection drum (13) is connected downstream via line (32) to a vibrating jig (14) connected to the atmosphere via a line (ATM), which operates substantially at atmospheric pressure in a nitrogen atmosphere and at a moderate temperature which is compatible with the flexible connecting sleeves used in conventional vibrating jigs. Drum (13), which comprises upstream and downstream isolating valves as well as pressurisation means which are not shown, operates as a decompression lock for the particles.

The outlet for fine particles from the vibrating jig (14) (particles which are, for example, free of large fragments of more than 3 mm in dimensions) is connected to a receiving drum (15) provided with upstream and downstream controlled valves, as well as supply means, not shown, for gas from the group formed by nitrogen and fuel gas. In practice, vibrating jig (14) is disposed above drum (15) to allow gravity flow of the powder (this is not the case in FIG. 1 for draughting reasons).

Thus equipped, drum (15) can operate as a pneumatic clearing lock, and constitutes a means for recycling erosive solid particles to the facility. It is connected upstream to a source of transport gas (33) (fuel gas, nitrogen or steam) and downstream to different injection means (19), (34) comprising controlled valves and solid particle injection lines. The particles can be injected upstream of cracking zones (2) via dotted lines (34), or preferably via lines (19), into the cracked gas transfer zones (3), and in particular to the inlet cones of the transfer line exchangers, which cones conventionally form part of the transfer zones (3). In this case, a diffusing impactor (35) is preferably installed in each inlet cone. The diffusing impactor has two purposes: protection of the tubular plate in the transfer line exchanger against erosion, and more regular distribution of the particles injected into the tubes of exchanger (4).

Diffusing impactor (35) is advantageously constituted by two levels of particle reflecting surfaces, offset from each other, such that it is both permeable to gases through a plurality of passages and substantially opaque viewed from upstream.

Clearing lock (15) comprises a line (36) for evacuating used particles; the used particles may also be sent to a storage drum via a diverter disposed in line (32); a drum (18) comprising controlled emptying means (screw or lock) allows the storage of "new" particles and replacement of used particles.

The facility also comprises pneumatic means for transferring particles from drums $V_i$ (6) to common separation and collection means via transfer channels (9). A source (31) of non coking gas with an atmospheric dew point of less than 110° C. (steam or, preferably, nitrogen or fuel gas), allows the following:

a) injection of a barrier gas upstream of valve (7) to oppose the arrival of cracked gases in receiving drum (6);

b) injection of a non coking gas with an atmospheric dew point of less than 110° C. via valve (25) to empty the gas contained in receiving drum $V_i$ (6), before evacuation and transfer of the particles, and to pressurise drum (6) during pneumatic transfer of the particles;

c) injection of such a gas into the solid particles via valve (26) to dry, at least partially, any traces of liquid by percolation of a dry gas;

d) injection of a controlled flow of transport gas via valve (27) during pneumatic transfer of the particles.

Finally, the facility described in FIG. 1 comprises a programmable control device (17) to control the sequential operation of the facility, in particular the valves of the decompression lock and the pneumatic clearing locks. It also comprises means (20) for injection upstream of the cracking zone (2) of chemical compounds which catalyse the gasification of coke by steam, for example aqueous solutions of an equimolar mixture of sodium carbonate and potassium carbonate, or an equimolar mixture of sodium acetate, potassium acetate, lithium acetate and barium acetate.

These compounds have a surprising anticoking effect in cracking zones (2).

Figure 2:
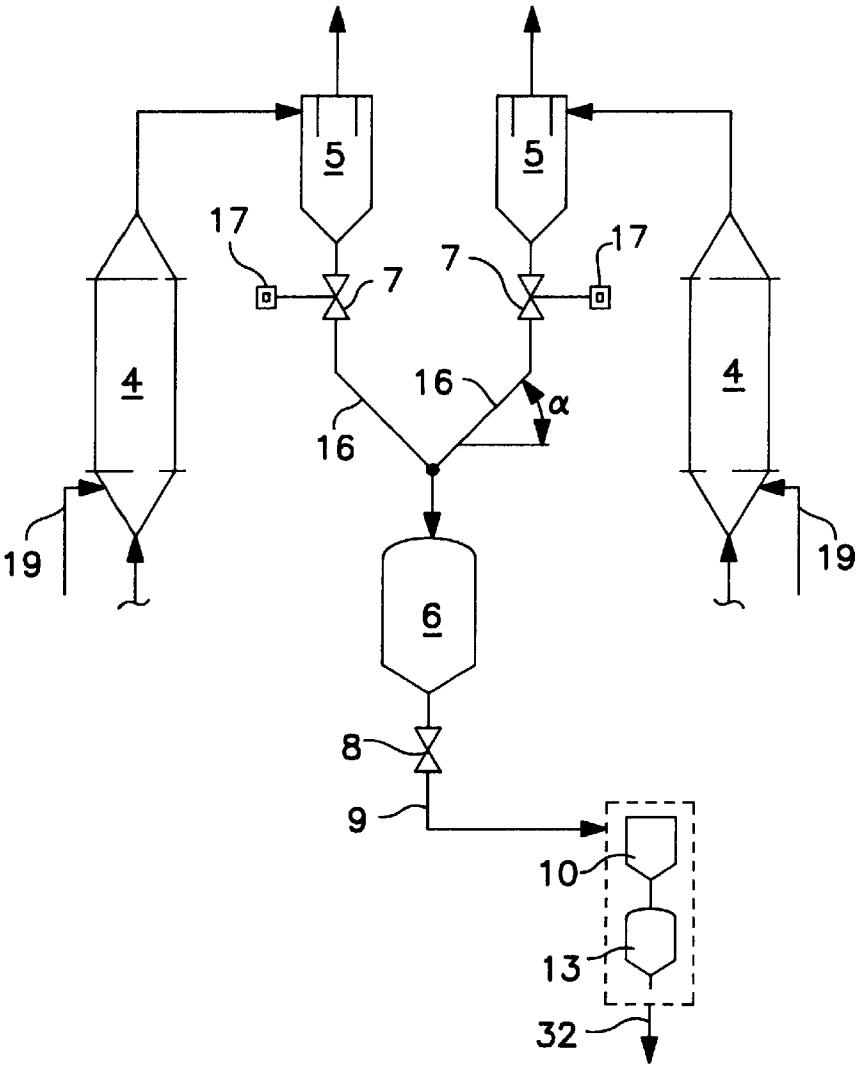
FIG. 2 schematically represents a portion of a facility comprising a device in accordance with one of the variations of the invention.

Referring now to FIG. 2, which is a schematic representation of two transfer line exchangers (4), TLE, whose inlet cones each comprise a line (19) for injection of solid erosive particles. These exchangers are connected downstream to two primary separators (5) which are connected via lines (16) each comprising a controlled isolation valve (7) to the same receiving drum (6), which constitutes one of the drums $V_i$ of the facility, and is thus associated with the two primary separators (5) shown. Downstream of the receiving drum, a transfer channel (9) comprising a controlled valve (8) sequentially transfers the particles to common separation and collection means (10), (13), these being connected via other transfer channels (9) to other receiving drums $V_i$, not shown. Drum (6) operates as a pneumatic clearing lock, with pressurisation of the lock and evacuation of the particles by a transport gas.

In FIG. 2, the disposition of the two primary separators (5) is not random, but these separators are installed close enough together so that the connection lines (16) with the single receiving drum (6) are highly inclined and form an angle $\alpha$ with the horizontal of at least 60°.

Figure 3:
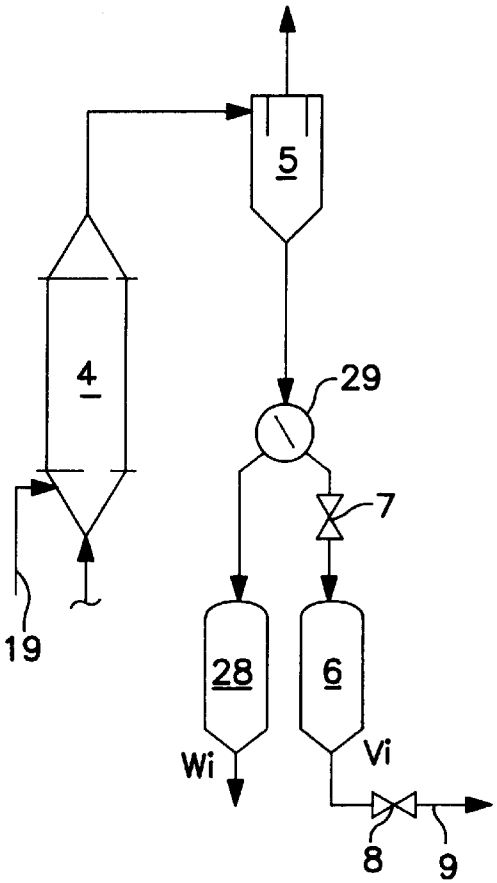
FIG. 3 represents a portion of a facility comprising a further device in accordance with the invention.

Referring now to FIG. 3, this represents a transfer line exchanger (4) connected to a primary separator (5), itself connected to a receiving drum $V_i$ (6). FIG. 3 also includes other technical elements which have already been described above and have the same reference numerals. In addition, a further drum $W_i$ (28) for receiving solid particles is also connected to primary separator (5) and a controlled directional diverter (29) (shutter, clapper or equivalent technical device) can direct the particles recovered in primary separator (5) either to drum $V_i$ (6) or to drum $W_i$ (28).

The facility shown in FIG. 1 operates as follows:

A—Injection of solid erosive particles. Erosive particles are intermittently injected into the facility by means (19), constituted by controlled valves and injection lines. When a well known, constant feed is cracked, particles are injected via lines (34) upstream of cracking zones (2); when variable feeds are cracked under flexible conditions, the particles are principally or exclusively injected into transfer zones (3) at the level of the inlet cones of the transfer line exchangers; it has been found that variable conditions in the feeds could lead to pyrolysis tube coking rates which are difficult to predict and not suitable for controlling the injection of particles into the cracking zones. On the other hand, fouling of the transfer line exchangers, which it has unexpectedly been shown is the sole limiting factor in the choice of feeds, in particular heavy feeds such as gas oils and vacuum distillates, can be simply and reliably determined simply by measuring the temperature at the outlet to the exchanger.

In addition, coke in the transfer line exchanger is, surprisingly, much easier to eliminate by erosion than that in the cracking zones. It is thus possible to control the quantities of particles which must be injected without first conducting tests, based on the temperature at the transfer line exchanger outlets.

Preferably, doses of fine erosive particles are injected discontinuously, each dose corresponding to a weight of particles which is typically between 5 and 150 kg, in particular between 20 and 100 kg. There are two possible types of injection control: in the first type, the particles are injected at a given injection point at fixed time intervals, for example every 3 hours. The quantity injected is adjusted (for example using weighing means, not shown in FIG. 1) so that the increase in the temperature at the transfer line exchanger outlet concerned located downstream of the injection point remains moderate, for example less than 100° C. per month, preferably 30° C. per month or substantially zero.

In another type of control, constant doses of particles are injected, but at varying time intervals, to limit or cancel the increase in temperature at the transfer line exchanger outlet.

Particles typically injected via line (19), typically comprising 1 to 8 particle injectors at its end in the inlet cone of a transfer line exchanger (4), are entrained by the cracked gases, reflect off the diffusing impactor (35) and distribute themselves better in the tubes in exchanger (4), where they circulate at flow rates in the range 20 to 180 m/s, preferably in the range 35 to 120 m/s, and scrape off a portion of the coke or heavy tar deposited on the walls of the tubes.

These particles are then separated in cyclone (5), and fall via line (16) into receiving drum (6), typically kept at 150° C. by heating means (37). Controlled valve (7) is thus open during injection of the particles, to allow their recovery in drum (6); in contrast, controlled valve (8) is closed during this period. After injection of the particles, which are temporarily stored in the corresponding drum (6), "clean" dry gas, for example fuel gas or nitrogen, from a supply (31) is injected via lines (25) and (26). This means that a first drying of the particles (which may contain traces of liquid) as well as flushing the gas contained in drum $V_i$ can be effected to eliminate any traces of cracked gases. Controlled valve (7) is then closed to isolate drum (6) from upstream, and pneumatically transfer the particles by pressurising drum (6), for example using valve (25), opening outlet valve (8) and injecting a controlled flow of clean dry transport gas via valve (27). This operation of drum (6) as a pneumatic clearing lock can, without departing from the scope of the invention, be carried out in several ways which are known to the skilled person, for example by fluidizing the particles by opening valve (8) and injecting transport gas before pressurizing the drum, using an outlet valve (8) in pipework which may, for example, be horizontal, inclined or vertical and upward.

The particles are then evacuated either as a dense or as a diluted phase via transfer channel (9). In accordance with the invention, the flow rate $q_i$ of the transport gas required to carry out the transfer is much lower than that of the cracked gases passing through primary separator (5). Channel (9) thus has a small diameter, as have valves (7) and (8): due to the change in the gas transporting the particles (cracked gases→clean dry gas ($N_2$, fuel gas)), the necessarily very high flow rate of the cracked gas has been decoupled.

Typically, line (9) and valves (7) and (8) have a diameter of less than 100 mm compared with a typical 350 mm for the particle transfer lines in the prior art process described. In addition, line (9) is relatively cold, generally not traced and unlagged over at least a portion thereof and can be produced from carbon steel.

Transfer of particles according to the invention is thus particularly economical, and also reliable since the particles can be dried in receiving drum $V_i$ (6) then in a circulating bed due to the transport gas in the transfer channel (9).

The transfer channel, whose length is a minimum of several metres, for example between 5 and 100 m, can cool the particles (heat exchange with the colder walls of channel (9) being encouraged by the circulating fluidized bed). This is a further advantage of the invention: in effect, it allows a conventional vibrating jig to be used downstream, which is very reliable and proven, and comprises flexible connecting sleeves which would not be compatible with the initial temperatures of the particles in primary separator (5).

The particles passing into channel (9) are thus cooled to a preferred typical temperature of 80° C. to 150° C., which is moderate and compatible with the vibrating jig, but sufficient to effect any required drying of the particles.

The particles then pass into the common separation and collection means via transfer channel (9).

The common means comprise a particle/transport gas separating cyclone (10) and a drum (13) for collecting the particles. The purified transport gas is sent via line (11) to line (12) evacuating the cooled cracked gases.

Sequentially, after recovering a dose of particles or several doses of particles, collecting drum (13) is isolated from upstream, depressurised by means which are not shown, and emptied via evacuating line (32). Emptying, for example tinder gravity, is facilitated by the fact that the particles are dry and not sticky. The particles are then sieved in vibrating jig (14) which eliminates fragments with a dimension of more than 3 mm, and the particles then fall into receiving drum (15) whose upstream valve is open and whose downstream valve is closed.

Fine sieving of the particles is required when the particles are recycled, to avoid blocking the injectors at the end of line (19), which are typically of small dimensions (for example 15 mm). A first very coarse screening (15 to 20 mm mesh) can be carried out using a simple grate in the receiving drums (6) to prevent any risk of obstructing transfer channels (9).

When the sieved particles are in drum (15), they can be recycled, by isolating the drum (15) from upstream and injecting a pressurizing gas and a transport gas using the same operation as for drum (6): evacuation via a pneumatic clearing lock as in a number of variations, as for lock (6). Fuel gas or nitrogen is the preferred transport gas.

Controlled valves comprised in particle injection means (19) mean that the injection points can be selected, for example those for the transfer line exchanger with the highest outlet temperature. Drum (15) also comprises means (16) for evacuating used particles, which have a reduced erosive efficiency after circulating a number of times. The dose of used particles is then replaced by new particles stored in drum (18), and transported by a transport gas supply (33).

The facility of FIG. 1 can also be used to inject chemical decoking agents via means (20) which can comprise a reservoir for an active solution and a dosing pump. These compounds are injected continuously or discontinuously, in a fine spray into the cracked gases.

The facility can also comprise a control module (17, see FIG. 2) such as a programmable control device which can operate all the sequential operations automatically.

The apparatus shown in FIG. 2 operates as for FIG. 1. The two valves (7) are never, however, simultaneously open, in order to avoid unwanted circulation between the two cyclones (5) via lines (16). The particles are thus injected into the two exchangers (4) during different phases, the corresponding valve (7) only being open during injection. The minimum angle $\alpha$ of at least 60° ensures gravity flow of the recovered particles.

The apparatus shown in FIG. 3 operates as follows:

During the particle injection phases, the directional diverter (29) is angled as shown in the figure to allow recovery of the erosive particles in receiving drum (6). Outside the injection phases, i.e., for the majority of the time, the diverter is angled in the opposite direction, so that the particles fall into receiving drum $W_i$ (28). Thus coke particles detached from the walls which spontaneously circulate in the facility which result from embrittlement of the coke by the injected chemical compounds, do not mix with the erosive particles recovered in drum (6). This improves the operation and reliability of the facility. Undesirable particles can also be prevented from falling into drum (6) by closing valve (7) then injecting a gas to flush out the particles located above that valve.

EXAMPLES

Example 1 (comparative)

A steam cracking facility comprising 10 furnaces and 20 transfer line exchangers with a unit capacity of 10000 kg/h of cracked gas was used, provided with means for injecting coke erosion particles upstream of the exchangers.

In a first variation, the particles contained in the effluents from the transfer line exchangers were transported by these effluents to the general treatment system for the cracked gases, comprising a single cyclone. In this facility, there were 20 outlet lines for cracked gases which transported the particles to the common cyclone.

There were, therefore, 20 large diameter lines (350 mm, for example) for circulating the particles, each line having a unit capacity of 10000 kg/h of cracked gases. The common cyclone had a capacity of 20×10000 kg/h, i.e., 200000 kg/h. It was thus of considerable size, very difficult to install and not very efficient. This variation was not in accordance with the invention.

In a second variation, already described above, each transfer line exchanger outlet comprised two controlled valves to direct the effluent either to the downstream treatment system for the cracked gases when no particles were being injected, or to the common separation and collection means.

This known facility transported the particles to a single point via 20 supplementary lines for cracked gas, typically with a 350 mm diameter, and included 20×2, i.e., 40 special valves with large diameters capable of directing the cracked gases to the suitable system.

The cyclone had a reasonable capacity, 10000 kg/h, and was easily installed and efficient.

This costly facility was not in accordance with the invention.

Example 2

In accordance with the invention:

In this case, a steam cracking facility comprising 10 furnaces and 20 transfer line exchangers with a unit capacity of 10000 kg/h was also used. The facility comprised 20 primary cyclones (5), each provided with a receiving drum (6). These primary cyclones had a unit capacity of 10000 kg/h and were thus efficient and easy to install. Each of the 20 receiving drums (6) was connected via a transfer channel (9) to a common cyclone (10). Thus there were 20 transfer channels. Since the unit flow rate selected for the transport gas was 1000 kg/h of fuel gas for each channel (9), this flow rate was far lower than the flow rate of 10000 kg/h for the cracked gases passing through a primary separator, and was in accordance with the invention.

The transfer channels (9) thus had very small diameters (50 to 100 mm), and cyclone (10) was also very small (1000 kg/h capacity).

With this facility, erosive particles could be injected, for example in doses of 50 kg of angular coke or angular silicon carbide, and the particles could be recovered at a common location. Because of these injections, fouling of the transfer line exchangers could be avoided and unconventional feeds could be cracked (kerosine, gas oil, condensates) in cycles of over 1 month, something which was not possible with no particle injection.

Preferably, in particular for mineral particles, the majority of the recovered particles were recycled.

Example 3

The facility of Example 2 was used, comprising 20primary separators (cyclone (5)), but only 10 receiving drums (6) disposed as shown in FIG. 2, and 10 transfer channels (9) with a unit capacity of 1000 kg/h of fuel gas.

This facility, which was in accordance with the invention, was more economical than that of Example 2.

Example 4

The same steam cracking facility was used, except that not 20 but 10 primary separators (5) were installed, each separator collecting the effluents from two transfer line exchangers (one furnace). 10 receiving drums $V_i$ and 10 transfer channels (9) were used, with a unit capacity of 1000 kg/h of fuel gas. This facility had a recovery efficiency which was slightly lower than that of Examples 2 and 3, but was less costly.

Example 5

The facility of Example 4 was used, completed by means (20) for injection of 10 to 100 ppm of chemical compounds (weight of sodium plus potassium) with respect to the cracked gases, in an aqueous solution containing 96% water with an equimolar sodium carbonate and potassium carbonate composition. These compounds encouraged coke gasification in the cracking zones and also caused embrittlement of the coke and emission of fragments detached from the walls.

In order that the coke fragments were not mixed with the injected erosive particles (for example silicon carbide), 10 diverters (29) and 10 receiving drums $W_i$ were installed as shown in FIG. 3.

In general, the invention thus provides a process and a facility, in a number of variations, which can use efficient decoking agents to allow feeds which are impossible to crack under conventional conditions to be cracked without excessive fouling, and to recover the solid particles generated by this operation more economically and more reliably than in the prior art processes and facilities described.

We claim:

1. A process for the steam cracking of hydrocarbons in a facility comprising at least one steam cracking furnace, the facility comprising a plurality of cracking zones (2) and a plurality of transfer line exchangers (TLE) (4) for the cracked gases from these cracking zones, the process comprising injection, at a plurality of points, of decoking agents resulting in the circulation of decoking agents comprising solid particles in said transfer line exchangers, the process comprising separation of at least a portion of said solid particles from the transfer line exchanger effluents in a plurality of primary gas/solid separators (5), and recovery of at least a portion of these solid particles downstream of these transfer line exchangers in common separation and collection means assembled at a single point, the process being characterized in that:

at least a portion of the separated particles from the primary separators is recovered by gravity flow in a plurality of receiving drums $V_1 \ldots, V_n$, each drum $V_1$ being associated with at least one primary separator; and each of the receiving drums $V_i$ is sequentially isolated from the associated primary separator(s) then at least the majority of the particles contained in drums $V_i$ is pneumatically transferred to said common separation and collection means by a non coking transport gas with an atmospheric dew point of less than 110° C., the flow rate $q_i$ of the transport gas for evacuating the particles contained in drum $V_i$ being less than or equal to 30% of the volumetric flow rate of the cracked gases passing through the primary separators associated with $V_i$.

2. A process according to claim 1, characterized in that the particles transferred from drum $V_i$ are extracted from that drum by exclusively pneumatic means.

3. A process according to claim 1, in which receiving drums $V_i$ are heated by heating means whose temperature level is between 110° C. and 340° C., remaining above the dew point of the transport gas at the maximum operating temperature of drums $V_i$.

4. A process according to claim 1, in which the gas contained in drum $V_i$ is flushed by a non coking gas with an atmospheric dew point of less than 110° C. before isolating drum $V_i$ then transferring the particles contained in $V_i$.

5. A process according to claim 1, in which the particles contained in drum $V_i$ are percolated by a non coking gas with an atmospheric dew point of less than 110° C. before isolating drum $V_i$ then transferring the particles contained in $V_i$.

6. A process according to claim 1, in which the transport gas is uncondensable at normal temperatures and pressures, and is selected from the group consisting of nitrogen, methane, hydrogen, light hydrocarbons containing two to four carbon atoms, and mixtures thereof.

7. A process according to claim 1, in which at least a portion of the decoking agents is injected during normal operation of the facility.

8. A process according to claim 1, in which the decoking agents comprise solid erosive particles, injected upstream of the transfer line exchangers, in particular into the transfer zones (3) comprised between the outlets to the cracking zones (2) and the transfer line exchangers (4).

9. A process according to claim 1, in which at least a portion of the particles recovered in the common collection means is recycled to a point upstream of at least one transfer line exchanger, after a jigging operation carried out on at least said portion of particles recovered from the common means, the jigging operation being carried out at atmospheric pressure and in an essentially nitrogen atmosphere.

10. A process according to claim 1, in which the anticoking compounds comprise mineral salts which catalyze the gasification of coke by steam, injected upstream of the cracking zones (2).

11. A process according to claim 10, characterized in that said mineral salts comprise at least one salt from an element selected from the group consisting of sodium, potassium, lithium, barium and strontium, the salt being active in promoting gasification of coke.

12. A steam cracking facility comprising at least one steam cracking furnace (1), a plurality of cracking zones (2), and a plurality of transfer line exchangers (4) for the cracked gases from the cracking zones, the facility also comprising means for injecting decoking agents, at a plurality of points, resulting in the circulation of solid particles in the transfer line exchangers, a plurality of primary gas/solid separators (5) for purifying the effluents from the transfer line exchangers, each primary separator being connected upstream to at least one transfer line exchanger associated therewith and comprising an outlet for purified gas and an outlet for solid particles, and means for recovering at least a portion of these solid particles, these recovery means comprising common separation and collection means assembled at a single point, the facility being characterized in that it comprises:

a plurality of drums $V_i$ for recovery of at least a portion of the particles separated in the primary separators by gravity flow, each drum $V_i$ being connected to at least one outlet for solid particles from at least one primary separator associated with $V_i$;

a plurality of solid particle transfer channels, each channel being connected upstream to one of the drums $V_i$ and downstream to said common separation and collecting means; and means for sequentially isolating each drum $V_i$ from the separator(s) associated therewith, and pneumatic means for transferring, via said transfer channels, at least the major portion of the particles contained in the isolated drums $V_i$, the pneumatic means comprising means for supplying a non coking transport gas with an atmospheric dew point of less than 110° C.

13. A facility according to claim 12, characterized in that each drum $V_i$ is connected to means for evacuating particles, said means being exclusively pneumatic and using at least one source of a transport gas selected from the group formed by nitrogen and fuel gas.

14. A facility according to claim 12, comprising heating means for heating drums $V_i$.

15. A facility according to claim 12, comprising means for flushing the gas contained in drums $V_i$ using a source of a non coking gas with an atmospheric dew point of less than 110° C.

16. A facility according to claim 14, comprising means for introducing a non coking gas with an atmospheric dew point of less than 110° C. into the particles contained in drums $V_i$ to percolate through the particles before their evacuation from drums $V_i$.

17. A facility according to claim 12, in which the decoking agents comprise solid erosive particles, the facility comprising means for injecting said particles upstream of the transfer line exchangers, in particular into the transfer zones between the cracking zones and the transfer line exchangers.

18. A facility according to claim 17, in which the totality of the solid particles is injected into the transfer zones (3) for the cracked gases between the cracking zones (2) and the transfer line exchangers (4), in particular into the inlet cones of the transfer line exchangers.

19. A facility according to claim 12, in which the common separation means (10), (13) comprise an outlet for purified transport gas connected via a line (11) to a line (12) for circulation of cracked gases, to evacuate the purified transport gas.

20. A facility according to claim 12, comprising means for recycling at least a portion of the particles recovered in the common separation and collection means to the transfer zones (3).

21. A facility according to claim 20, comprising a vibrating jig (14) operating in a nitrogen atmosphere substantially at atmospheric pressure and at a temperature of less than 200° C., connected upstream to common separation and collection means (10), (13) and connected downstream to particle recycling means (15), (19).

22. A facility according to claim 12, comprising at least two primary separators (5) associated with the same receiving drum (6), each primary separator associated with said receiving drum (6) being connected to said drum via a line (16) and comprising control means (17) for means (7) for sequential obstruction of at least one of the lines (16) when the other line is open, the relative disposition of the primary separators (5) and the receiving drum (6) being such that the lines (16) are inclined at an angle of at least 60 degrees to the horizontal.

23. A facility according to claim 12, comprising means for injecting decoking agents comprising chemical compounds which catalyze the gasification of coke by steam, upstream of the cracking zone (2).

24. A facility according to claim 12, comprising means for sequential injection of erosive particles connected to the transfer zones (3), means for sequential isolation of each drum $V_i$ outside the phases for injection of particles upstream of $V_i$, and means for evacuating particles recovered from the separator(s) (5) associated with $V_i$ outside the injection phases without passing through $V_i$.

25. A facility according to claim 24, comprising drums $W_i$ for receiving the particles recovered outside the particle injection phases, and controlled directional diverters at one inlet and two outlets, each diverter being connected upstream to a primary separator and downstream to a receiving drum $V_i$, and to a receiving drum $W_i$.

26. A process according to claim 3, wherein the temperature level is between 150° C. and 250° C.

27. A process for the steam cracking of hydrocarbons in a facility comprising at least one steam cracking furnace, the facility comprising a plurality of cracking zones (2) and a plurality of transfer line exchangers (TLE) (4) for the cracked gases from these cracking zones, the process comprising injection, at a plurality of points, of decoking agents resulting in the circulation of decoking agents comprising solid particles in said transfer line exchangers, the process comprising separation of at least a portion of said solid particles from the transfer line exchanger effluents in a plurality of primary gas/solid separators (5), and recovery of at least a portion of these solid particles downstream of these transfer line exchangers in common separation and collection means assembled at a single point, the process being characterized in that:

at least a portion of the separated particles from the primary separators is recovered by gravity flow in a plurality of receiving drums $V_1 \ldots, V_n$, each drum $V_1$ being associated with at least one primary separator; and each of the receiving drums $V_i$ is sequentially isolated from the associated primary separator(s) then at least the majority of the particles contained in drums $V_i$ is pneumatically transferred to said common separation and collection means by a non coking transport gas.

28. A process according to claim 27, wherein said non-coking transport gas has an atmospheric dew point of less than 110° C.

29. A process according to claim 27, wherein the flow rate $q_i$ of the transport gas for evacuating the particles contained in drum $V_i$ being less than or equal to 30% of the volumetric flow rate of the cracked gases passing through the primary separators associated with $V_i$.

* * * * *